US008021007B2

(12) United States Patent
Rapeanu et al.

(10) Patent No.: US 8,021,007 B2
(45) Date of Patent: Sep. 20, 2011

(54) CONCEALED EMERGENCY LIGHTING EQUIPMENT WITH COMPLETE RETROFIT HOUSING AND METHOD OF INSTALLATION

(75) Inventors: Radu Cornel Rapeanu, Mont-Royal (CA); Donald Ermekeil, Pierrefonds (CA); Chantal Dorval, Laval (CA)

(73) Assignee: Thomas & Betts International, Inc., Wilmington, DE (US)

( * ) Notice: Subject to any disclaimer, the term of this patent is extended or adjusted under 35 U.S.C. 154(b) by 314 days.

(21) Appl. No.: 12/381,490

(22) Filed: Mar. 12, 2009

(65) Prior Publication Data

US 2009/0244880 A1 Oct. 1, 2009

Related U.S. Application Data

(60) Provisional application No. 61/072,267, filed on Mar. 28, 2008.

(51) Int. Cl.
*F21V 19/04* (2006.01)

(52) U.S. Cl. ..... 362/20; 362/154; 362/183; 362/198; 362/287; 362/391

(58) Field of Classification Search ..... 362/20, 362/154, 183, 198, 199, 287, 391
See application file for complete search history.

(56) References Cited

U.S. PATENT DOCUMENTS 3,121,259 A * 2/1964 Versen ..... 52/28
4,030,259 A * 6/1977 Meckler ..... 52/220.3
4,802,065 A 1/1989 Minter et al.
4,835,915 A * 6/1989 Nilssen ..... 52/28
5,408,394 A 4/1995 Mandy (Continued)

FOREIGN PATENT DOCUMENTS

DE 29815368 U1 1/1999

(Continued)

OTHER PUBLICATIONS

McPhilben Emergency Lighting, "FAZE[180] Series" Concealed Emergency Unit, Day-Brite® Lighting, Jul. 1, 2007.

(Continued)

*Primary Examiner* — Stephen F Husar
*Assistant Examiner* — James Cranson, Jr.
(74) *Attorney, Agent, or Firm* — Hoffmann & Baron, LLP

(57) ABSTRACT

A concealed emergency lighting system that includes a lamp assembly box and a power source box and a method for installing the emergency lighting system is disclosed. The lamp assembly box has a face plate and a front door pivotably moveable between an open and a closed position and a lamp assembly. The power source box includes a battery and other electrical components that are connected to the lamp assembly. The emergency lighting system can also include a mounting bracket with screws, a flexible support and a flexible armored cable. The method of installing the concealed emergency lighting system includes the steps of: forming an opening in a wall; attaching the mounting bracket to a stud through the opening; connecting the power source; inserting the power source box and the lamp assembly box through the opening; and securing the lamp assembly box to the mounting bracket.

13 Claims, 9 Drawing Sheets

U.S. PATENT DOCUMENTS

| | | | | |
|---|---|---|---|---|
| 5,851,061 | A | 12/1998 | Hegarty | |
| 5,890,794 | A * | 4/1999 | Abtahi et al. | 362/294 |
| 6,164,788 | A | 12/2000 | Gemmell et al. | |
| 6,371,621 | B1 | 4/2002 | Le Bel | |
| 6,457,270 | B1 * | 10/2002 | Stark et al. | 40/570 |
| 6,499,866 | B1 * | 12/2002 | Logan et al. | 362/362 |
| 7,290,574 | B2 * | 11/2007 | Baber | 144/135.2 |
| 2007/0274083 | A1 * | 11/2007 | Williams et al. | 362/364 |
| 2008/0239709 | A1 * | 10/2008 | Rapeanu et al. | 362/147 |

FOREIGN PATENT DOCUMENTS

| | | | |
|---|---|---|---|
| EP | 1378708 | B1 | 8/2008 |

OTHER PUBLICATIONS

Lithonia Lighting Emergency Lighting Systems, "VALARÉ," Acuity Lighting Group, Inc., Oct. 2005.
"Phantom™ Series," Thomas & Betts Limited, 2007.
"Isolite," Mini Genie Series Compact Fully Recessed, E3 Lighting, May 2, 2007.
"Aperion™ Retracted Recessed Emergency Light," Evenlite Inc., Oct. 2007.
"The Chameleon," Concealite Life Safety Products, 2003.
"Model: F5000 Series (Standard, SD & RT)," Concealite Life Safety Products, 2003.

* cited by examiner

FIG. 5A
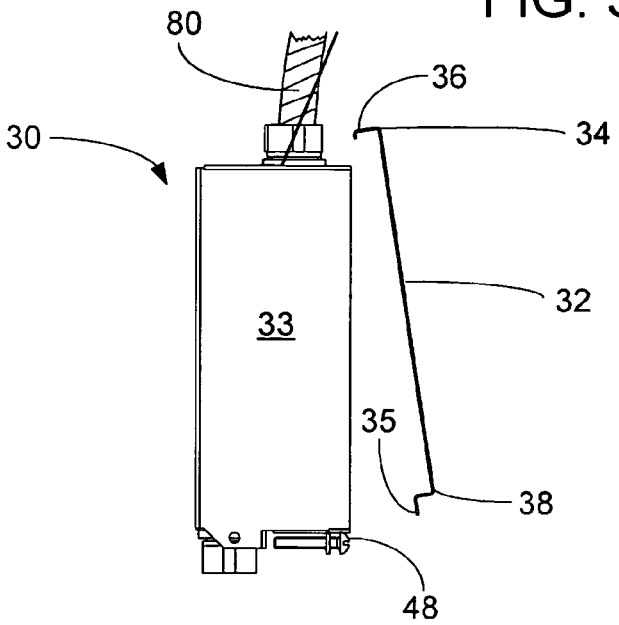
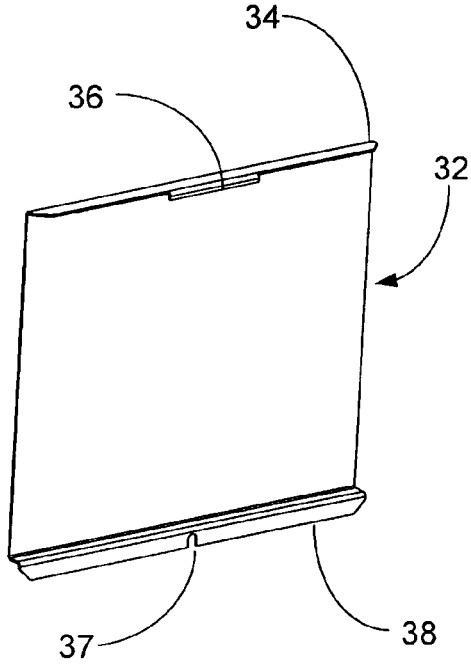
FIG. 5B
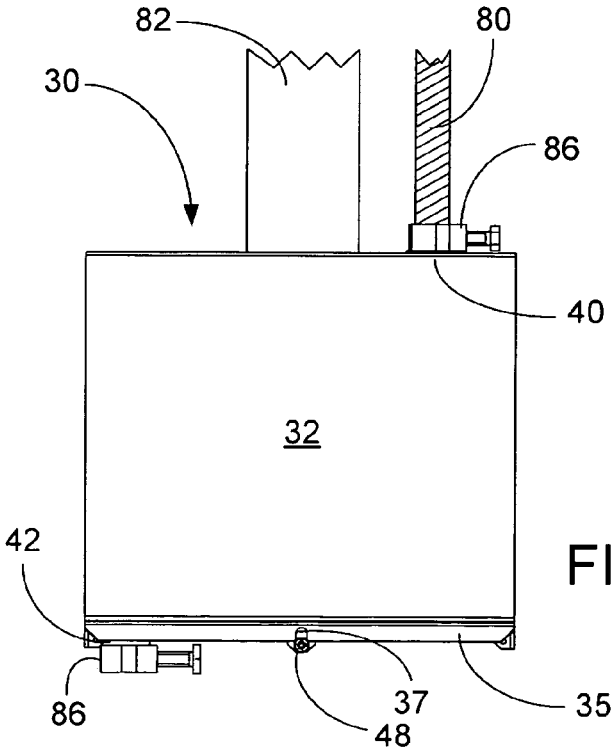
FIG. 5C

CONCEALED EMERGENCY LIGHTING EQUIPMENT WITH COMPLETE RETROFIT HOUSING AND METHOD OF INSTALLATION

This application claims priority from provisional application Ser. No. 61/072,267, filed on Mar. 28, 2008, which is incorporated herein in its entirety.

FIELD OF THE INVENTION

The present invention relates to emergency lighting equipment. In particular, the present invention relates to emergency lighting equipment that can be concealed in a small enclosure in a wall or ceiling when not in use.

BACKGROUND OF INVENTION

The prior art includes various designs for concealed emergency lighting fixtures, such as U.S. Pat. Nos. 5,025,349; 5,682,131; and 6,097,279 to Gow; U.S. Pat. No. 6,164,788 to Gemmel; U.S. Pat. No. 5,851,061 to Hegarty; U.S. Pat. No. 4,802,065 to Minter; and U.S. Pat. No. 6,371,621 to Le Bel et al. Most of these patents refer only to the module for the emergency heads (lamps) and disclose designs for completely concealing the emergency heads in an open wall or ceiling. They provide minimal disclosure relating to the installation of the complete system, i.e., the rechargeable batteries, charging electrical circuitry, etc. The prior art designs generally include a metal "back box" for housing all of the equipment. Due to its large size, the back box cannot be installed through the wall cutout for the emergency heads and must be installed in the wall before the wall covering (e.g., wallboard) is attached to the studs.

Many of the emergency lighting fixtures in the prior art designs contain only the emergency lights and use a remote emergency power source that can provide power for one or more lighting fixtures. Thus, these designs do not provide an independent, self-powered, battery back-up emergency lighting unit. Accordingly, there is a need for emergency lighting equipment that includes the emergency lights (lamp assembly) and the power supply circuitry and is designed so that all of the components can be installed through a relatively small cutout in the wall or ceiling.

SUMMARY OF THE INVENTION

In accordance with the present invention, concealed emergency lighting equipment and a method for installing the emergency lighting equipment are provided. The concealed emergency lighting equipment (also referred to herein as a concealed emergency lighting system) includes: a lamp assembly box, a power source box and a mounting bracket.

The lamp assembly box has a back wall, four contiguous side walls extending from the back wall to form a front opening defined by a perimeter, a face plate substantially parallel to the back wall extending outwardly from the perimeter, a front door pivotably moveable between an open position and a closed position and a lamp assembly. The back wall has a plurality of openings that are used to attach the lamp assembly box to the mounting bracket.

The power source box has a back wall, four contiguous side walls extending from the back wall to form a front opening, a front cover that is preferably detachable and a battery. The power source box can also have other electrical components such as a battery charger, one or more printed circuit boards, a transformer and a pair of rotatable hangers that are adapted to support the emergency lighting system. The lamp assembly is connected to the battery and/or the other electrical components by one or more wires or cables.

The concealed emergency lighting system can also include a mounting bracket, a flexible support connecting the lamp assembly box and the power source box and/or a flexible armored cable for housing the electrical wire that connects the lamp assembly box and the power source box. The mounting bracket is preferably U-shaped with a back wall and two side walls. However, brackets employing other shapes and designs can also be used. The side walls of the preferred U-shaped bracket have one or more apertures for attaching the bracket to a stud or some other part of the wall. The bracket can also have one or more fastening members extending from the front surface of the back wall. These fastening members are used to secure the lamp assembly box to the bracket and they are located so that they correspond with the apertures in the back wall of the lamp assembly box.

The method of installing the concealed emergency lighting system described above in a wall with a wall cavity includes the steps of: forming an opening in a wall next to a stud to access the wall cavity; inserting the mounting bracket through the opening and attaching the mounting bracket to the stud; attaching the power source box to the mounting bracket using the hangers; connecting a power source to the one or more power source devices in the power source box; disengaging the hangers from the mounting bracket; inserting the power source box through the opening in the wall and into the wall cavity; inserting the lamp assembly box through the opening in the wall; passing the screws in the mounting bracket through the mounting apertures in the back wall of the lamp assembly box; and tightening the screws to secure the lamp assembly box to the mounting bracket.

The method of installing the concealed emergency lighting system can further include: positioning the emergency lighting system so that the front door of the lamp assembly box and the cover of the power source box face away from the wall prior to connecting a power source to the one or more power source devices and/or installing the cover on the power source box prior to disengaging the hangers from the mounting bracket.

BRIEF DESCRIPTION OF THE FIGURES

The preferred embodiments of the concealed emergency lighting system of the present invention, as well as other objects, features and advantages of this invention, will be apparent from the accompanying drawings wherein:

FIG. 5A is a side view of an embodiment of the power source box with the cover removed.

FIG. 5B is a perspective view of the cover for the power source box shown in FIG. 5A.

FIG. 5C is a front view of the power source box shown in FIG. 5A with the cover attached.

DETAILED DESCRIPTION OF THE INVENTION

Figures 1A, 1B:
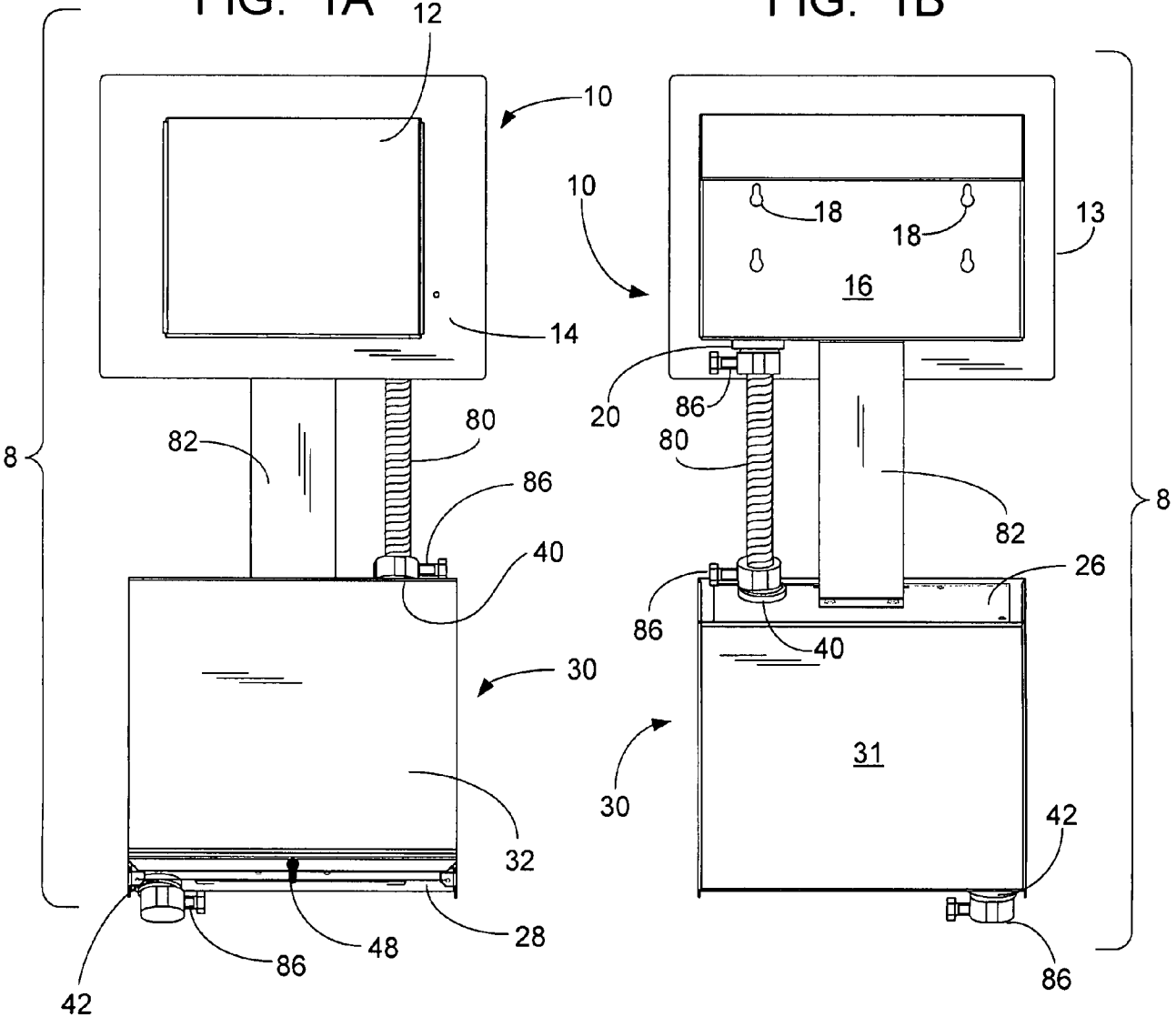
FIG. 1A is a front view of an embodiment of the emergency lighting system and shows the lamp assembly box with the front door in the closed position connected to the power source box by an armored cable and flexible support.
FIG. 1B is a rear view of the emergency lighting system shown in FIG. 1A.

The present invention is a self-powered emergency lighting equipment (or emergency lighting system) that can be concealed in a wall or ceiling. The emergency lighting system includes a lamp assembly box that houses the emergency light and a power source box that houses the power source for the lamps. By using two separate boxes, the emergency lighting system can be easily installed in a wall without having to make more than one opening in the wall. The lamp assembly box can be connected to the power source box by an armored cable that contains the wires that connect the battery or other power source to the emergency light. The two boxes can also be tethered together by a flexible support that maintains the two boxes in a substantially fixed relationship to each other and minimizes stress on the armored cable.

The lighting fixture, also referred to herein as the "lamp assembly" contains the emergency lighting lamps and electro-mechanical devices for opening/closing the door and exposing/concealing the lamps. The lamp assembly box has a back wall and four contiguous side walls which extend from the back wall to form a front opening defined by a perimeter. The lamp assembly box preferably houses two emergency lamps. However, depending on the size of the box and the type of lamps, any number of lamps can be installed in the box. The number or type of lamps that are installed in the lamp assembly box is not intended to limit the present invention in any way. A face plate substantially parallel to the back wall of the lamp assembly box extends outwardly from the perimeter formed by the side walls and a front door located in the opening pivotably moves between an open position and a closed position. In some embodiments, the back wall is formed by two sections. Three side walls extend from the first section of the back wall and, on the fourth side, the second section of the back wall extends at an angle to the fourth side wall. The dimension of the fourth side wall between the second section of the back wall and the face plate is selected so that the angle of incidence of the second section of the back wall to the first section is between about 30 and 60 degrees.

The power source box includes a back wall, four contiguous side walls extending from the back wall to form a front opening in the power source box, a detachable front cover and one or more power source devices. The power source devices can include a battery a battery charger, one or more printed circuit boards and a transformer. The power source devices can be connected to an external AC or DC power source, which can be used to recharge the battery and/or power the lamp assembly. Upon loss of the external AC or DC power source, the power source for the lamp assembly is automatically switched to the battery. However, the emergency lighting system does not require an external power source and can operate independently using a battery or similar device located in the power source box. In its simplest form, the emergency lighting equipment includes two boxes: a lamp assembly box mounted in a wall opening and connected to a power source box by a flexible armored cable and a flexible support.

The method of installing the concealed emergency lighting system in a wall with a wall cavity includes forming an opening in the wall next to a stud. The dimensions of the opening are determined by the dimensions of the lamp assembly box and the power source box. The opening has to be large enough for the two boxes to pass through and small enough so that it is concealed by the face plate of the lamp assembly box after the installation is completed. The mounting bracket is inserted through the opening, positioned flush against the side of the stud and attached to the stud using one or more screws or other fastening means. The emergency lighting system is oriented so that the lamp assembly box is suspended from the power source box and the front of the lamp assembly box and the power source box face away from the wall (i.e., towards the interior of the room) so that they can be easily accessed. The hangers on the bottom of the power source box are then attached to the bracket to support the emergency lighting system in an inverted position, which frees the hands of the installer to connect the external power source to the power source devices in the power source box.

After the power connections are made, the cover on the power source box is attached and secured to the box. The hangers are disengaged from the bracket and the emergency lighting system is positioned (i.e., turned around) so that the front door of the lamp assembly box and the cover of the power source box face the wall. The power source box is then inserted through the opening in the wall and slides down into the wall cavity and the lamp assembly box follows it through the opening in the wall. It will be understood by those skilled in the art that the lamp assembly box and the power source box can be designed to provide access to the interiors from various sides. Thus, the orientation of the two boxes during the installation procedure will be determined accordingly.

The base of the U-shaped bracket has one or more mounting members, preferably bolts, screws or anchors, which pass through the mounting apertures in the back wall of the lamp assembly box. The apertures in the back wall and the bracket mounting members are located so that they can be accessed without removing the lamp assembly and so that they align when the lamp assembly box is properly positioned. The screws are tightened to secure the lamp assembly box to the wall bracket. In addition to installing the emergency lighting system in an existing wall, the system can also be installed in a new construction in a similar manner.

The self-powered emergency lighting system is typically installed in walls that are constructed by attaching a wall covering (such as wall board or paneling) to studs. These walls have cavities between the studs and behind the wall covering in which the lamp assembly box and the power source box can be installed. This space behind the wall covering is referred to herein as the "wall cavity." For most installations, a single rectangular opening is cut into the wall next to a wall stud. This allows a bracket for the lamp assembly box to be attached to the stud. Preferably, the opening is about 8 inches by about 6 inches. However, lamp assemblies housed in boxes of different sizes are within the scope of the invention and these different lamp assembly boxes may require openings having different dimensions.

After the lamp assembly box is installed in a wall or ceiling, the door and the face plate completely conceal the opening in the wall. The self-powered emergency lighting system includes at least: the lamp assembly, the back-up battery, the electrical circuitry (i.e., a printed circuit board ("PCB") and a transformer) and space for making the connections with the mains power (i.e., the external AC or DC power source). The connections to the mains power are typically made using twist-on wire connectors or terminals blocks, but a variety of other types of connectors can also be used. The construction of the lamp assembly box and the power source box allows them to be installed in (and/or inserted into) a relatively small wall opening. Preferably, one or more of the corners on the back side of the boxes are provided with a curved or sloped wall between the side wall and the back wall. This makes it easier to insert an end of the box through the opening in the wall and rotate it so that the front face is accessible through the opening. In addition, the lamp assembly box has a rotatable front door and the power source box has a removable cover, which facilitate access for mechanical and electrical connections by the user.

The two boxes of the emergency lighting system are preferably made of sheet metal and structurally connected by a flexible bracket and electrically connected through a flexible wire conduit, preferably an armored conduit. However, if the local building and fire codes permit, the boxes can also be made of other materials such as molded or extruded plastic materials. The lamp assembly box includes the emergency lamps and the electro-mechanical components that open and close the door. An example of such a lamp assembly box is disclosed in U.S. patent application Ser. No. 12/045,804, filed on Mar. 11, 2008 and titled, "Concealed Emergency Lighting Fixture with Full Rotation of Door," which is incorporated herein by reference in its entirety. (This application was published as U.S. Patent Application Publication 2008/0239709 on Oct. 2, 2008.) The lamp assembly box has apertures, preferably keyhole apertures, in the back wall for attaching the box to a wall-mounted bracket, as described in more detail below.

The power source box has one or more openings in the bottom side wall for the passage of the electrical (AC and/or DC) wires from an external power source. The flexible support bracket is preferably formed from an elongated piece of sheet metal with the opposing ends bent to form a pair of mounting surfaces. The mounting surfaces are attached to the two boxes so that they remain a fixed distance apart. This relieves the stress on the armored cable that connects the two boxes. However, the flexible support bracket can also have alternative forms and can include one or more straps or cables attached to different surfaces of the boxes. One of ordinary skill in the art will appreciate that the two primary functions of the flexible support bracket are to mechanically connect the two boxes and to minimize stress on the electrical conduit and/or wires passing between the two boxes. Accordingly, any suitable means for accomplishing these functions would fall within the scope of the present invention.

Figure 3:
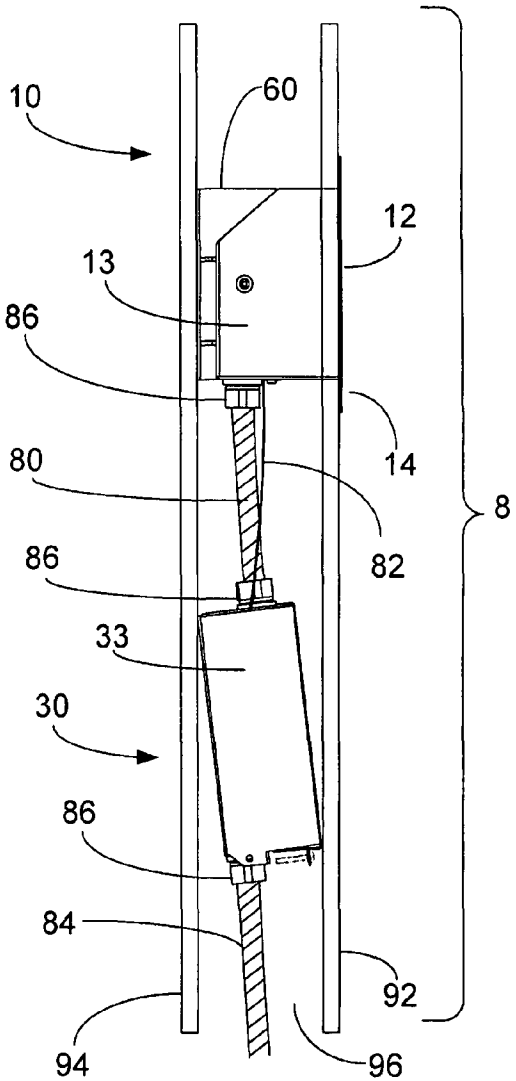
FIG. 3 is a side view of the emergency lighting system shown in FIG. 1A installed in a wall.
Figure 2:
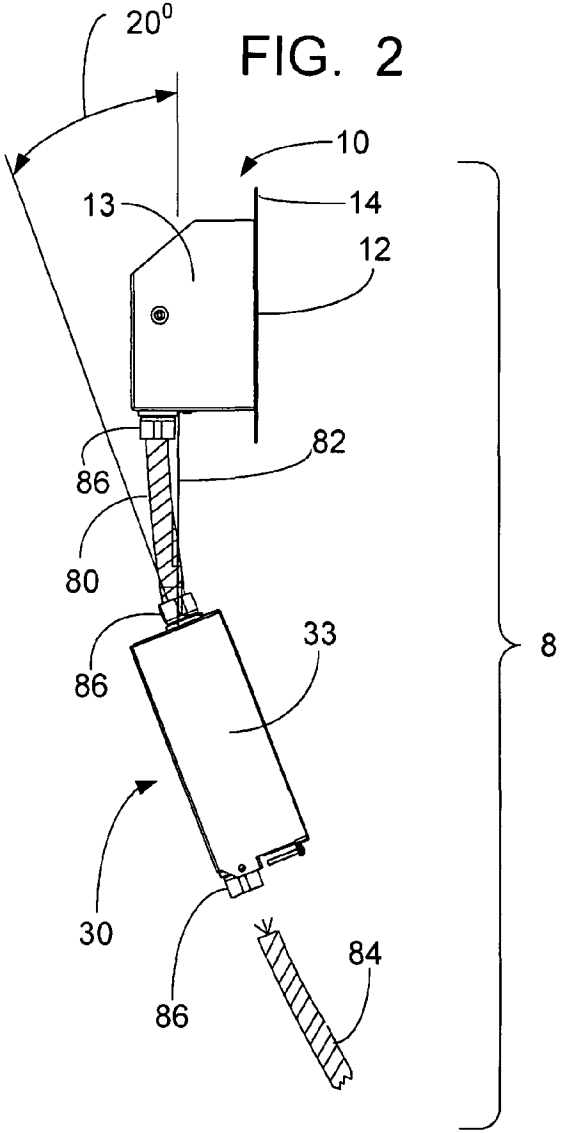
FIG. 2 is a side view of the emergency lighting system shown in FIG. 1A and shows the lamp assembly box disposed at a 20° angle to the power source box.

When the lamp assembly box is vertically oriented, the power source box is preferably aligned at an angle of about 20 degrees from vertical (as shown in FIG. 2) to facilitate installation of the power source box through the opening in the wall. In this configuration, at least a portion of the bottom of the power source box is in front of the front face of the lamp assembly box. During installation, the flexible support bracket and the flexible conduit bend to allow the power source box to pass through the wall opening and slide down into the cavity in the wall. In addition, the top side wall of the lamp assembly box can slope downwardly from about the mid portion of the side wall to the back wall at an angle (preferably between about 30° to 60°, most preferably about 45°) as shown in FIG. 2. This allows the lamp assembly box to be rotated more easily onto the U-shaped bracket after the bottom of the box is inserted into the opening in the wall (FIG. 3). After the emergency lighting system is installed (FIG. 3), the power source box preferably contacts both the front and the back drywalls with the lower and upper edges respectively. This minimizes any vibrations and noises when the emergency lighting system is in operation.

The power source box preferably houses at least a battery, a battery charger, a printed circuit board ("PCB") and an AC to DC transformer. In those applications where an external DC power source is available, the AC to DC transformer may not be needed. The transformer and charger are used to maintain the battery in a charged condition when external power is available. When the loss of external power is detected, the PCB switches to the battery. This type of arrangement is well know to those skilled in the art and is commonly used in emergency lighting systems. The box also has a dedicated space for electrical terminals or twist-on wire connectors that are used to connect AC and DC wires. FIG. 4 shows the preferred locations for these components. However, other arrangements of components are possible and the invention is not intended to be limited by the arrangement of the components in the power source box. The PCB is preferably installed in the portion of the power source box near the point where electrical wires enter the box from the flexible conduit that connects to the lamp assembly box. In preferred embodiments, not more than four (4) wires pass between the power source box and the lamp assembly box. Of these four wires, two (2) wires are used to supply the emergency lamps and the control circuit for the door movement. However, the invention is not limited by the number of wires passing between the two boxes as long as there are a sufficient number of wires for operation of the emergency lighting system.

The transformer is preferably installed in the upper corner of the power source box, next to the PCB and opposite the flex conduit entry into the box. The battery is preferably installed in the lower half of the power source box, below the PCB. The AC or DC wires for the external power source enter at the bottom of the power source box. If the power supply is DC, the transformer may not be needed. The power source box includes a rigid divider, which separates the components (transformer and PCB) in the upper half of the box from the battery. This divider has a hole near the transformer for the passage of AC and DC wires between the two sections of the box. The space between the divider and the battery can be used for the electrical connections between the wires coming into the box through the AC (or DC) remote cables (FIG. 4A) and the components in the box. These connections can be made by twisting the wires and installing twist-on wire connectors or terminal blocks can be used. The battery can be secured with a flexible bracket, which is preferably welded at one end to a side wall of the box and fixed at the other end with one or more screws or other type of fastener.

The power source box can have two wire hangers attached on the outside of the bottom side wall. The hangers can have hooks on one end and are preferably connected on the other end to an eyehole in a bracket attached to the box. This allows the hangers to be freely rotated (FIG. 4B) and used to temporarily hang or attach the emergency lighting system to the U-shaped bracket inside the opening in the wall or over the edge of the wall opening while the electrical connections are made. The preferred method for installing the emergency lighting system is described above.

The power source box has a front opening and a cover that fits over the opening to enclose the interior. The substantially flat cover fits over the front of the box and has two sides and an upper and lower end. The upper and lower ends can be bent to fit over the top and bottom side walls of the box. In a preferred embodiment, the upper end is bent about 90 degrees and has a tab that faces the cover. The tab is inserted into a slot in the top side wall of the power source box so that the rear surface of the cover contacts the edge around the opening that is formed by the side walls. The tab/slot combination allows the cover to pivotably move from an open to a closed position. In other embodiments, hinges or other mechanisms can be used to attach the upper end of the cover to the box. The lower end of the cover can be bent downwardly from the front surface and then outwardly to form a lip, substantially parallel to the front surface of the cover. A notch on the edge of the lip is used to fasten the cover to the box with a fastening device, such as a screw or latch, attached to the bottom of the box. The notch has an opening that receives the fastening device when the cover is in the closed position. Tightening the fastening device secures the cover to the box. When the fastening device is loosened, the cover is free to pivotably move between the open and closed positions or to be separated from the box. Other latching mechanisms can also be used for attaching the lower end of the cover to the box.

The lamp assembly box is preferably mounted in a wall using a "U-shaped" bracket that is attached to a wall stud. However, other types of mounting brackets can be used to secure the lamp assembly box in place. The bracket is preferably installed on a wall stud prior to the installation of the wall covering, but can also be installed in an existing wall. The U-shaped bracket has a back wall and two parallel side walls extending at substantially right angles from either side of the back wall. The end of one of the side walls (the side wall that is not attached to the stud) can be bent outwardly to form a flange that extends substantially perpendicular to the side wall. The side walls can also have one or more mounting holes for attachment of the U-shaped bracket to a stud and one or more openings for attaching the hangers on the power source box during installation.

In preferred embodiments, the side of the U-shaped bracket (see FIG. 6) that attaches to a wall stud has a length "a" which is greater than the wall interior clearance "b" (typically, the width of the stud, e.g. 3.5 in.) but less than the clearance from the surface of the wall covering (i.e., the width of the stud plus the drywall thickness, e.g., 3.5 in.+0.5 in). This side of the bracket is also provided with one or more mounting holes for attaching the U-shaped bracket to the stud. The other side of the bracket has the same length "b" as the wall interior clearance and the end is flanged at a right angle. When the bracket is installed in an opening in a wall, the user inserts the flanged end of the bracket through the opening and slides it over to the side so that the surface of the flange contacts the back surface of the wall. The other side of the bracket contacts the stud and the front edge extends almost to the front wall surface. This configuration prevents the bracket from accidentally falling inside the wall cavity. The base of the "U"-bracket has one or more (preferably four) PEM® nuts (i.e., self-clinching standoffs) with screws that are screwed in half-way. However, the base of the U-shaped bracket can also have tapped apertures (i.e., apertures with the sides threaded for accepting a screw) and a screw can be partially inserted in the tapped aperture. After the screws are inserted through the keyhole apertures in the back wall of the lamp assembly box, they are tightened to secure the box to the U-shaped bracket.

The components of the emergency lighting system (i.e., the lamp assembly and power source boxes as well as the flexible support bracket, flexible conduit and mounting bracket) are preferably made of metal. However, they can also be made of non-metallic materials, such as plastics, for applications where the building construction codes and regulations permit the use of such materials. Moreover, the concealed emergency lighting system can also be installed in open ceilings using an installation method similar to the method described for wall mounting.

Referring now to the drawings, FIG. 1A shows a front view of the concealable emergency lighting system 8, including the lamp assembly box 10 and the power source box 30 with the front door 12 and the front cover 32, respectively, in the closed positions. The lamp assembly box 10 is connected to the power source box 30 by a flexible armored cable 80 and a flexible support bracket 82. The lamp assembly box 10 has a face plate 14 which extends around the outside of the front door 12. The power source box 30 has a back wall 31, a pair of side walls 33, a top end wall 26, a bottom end wall 28 (FIG. 4A) and a front cover 32 that is secured in the closed position by a screw 48.

FIG. 1B is a rear view of the emergency lighting system 8 and shows the back wall 16 of the lamp assembly box 10 with a plurality of keyhole mounting apertures 18 and a perimetrical side wall 13. The lamp assembly box 10 and the power source box 30 each have openings 20, 40, respectively, for passing wires 70 (FIG. 4A) between the two boxes 10, 30. The wires 70 are protected by a flexible armored cable 80, which is secured to the lamp assembly box 10 and the power source box 30 by couplings 86. The flexible support bracket 82 is attached to the lamp assembly box 10 on one end and the power source box 30 on the other end and mechanically connects the two boxes 10, 30 to relieve stress on the flexible armored cable 80.

FIG. 2 is a side view of the emergency lighting system 8 and shows the power source box 30 disposed at a 20° angle from the lamp assembly box 10. This allows the power source box 30 to be inserted through an opening in a wall and then to slide downwardly as the lamp assembly box 10 is inserted in the opening. A cable 84 for external power is connected at the bottom end wall 28 of the power source box 30 by a coupling 86. The external power cable 84 is connected to the power source box 30 before the power source box 30 and lamp assembly box 10 are installed in the wall.

FIG. 3 is a side view of the emergency lighting system 8 and shows the lamp assembly box 10 and the power source box 30 installed in the cavity 96 of a wall 92. The lamp assembly box 10 is attached to a bracket 60 and the front face plate 12 is flush with the outer surface of the wall 92. The power source box 30 is suspended from the lamp assembly box 10 by the flexible support bracket 82 and resides in the cavity 96 formed by the opposing walls 92, 94.

Figure 4B:
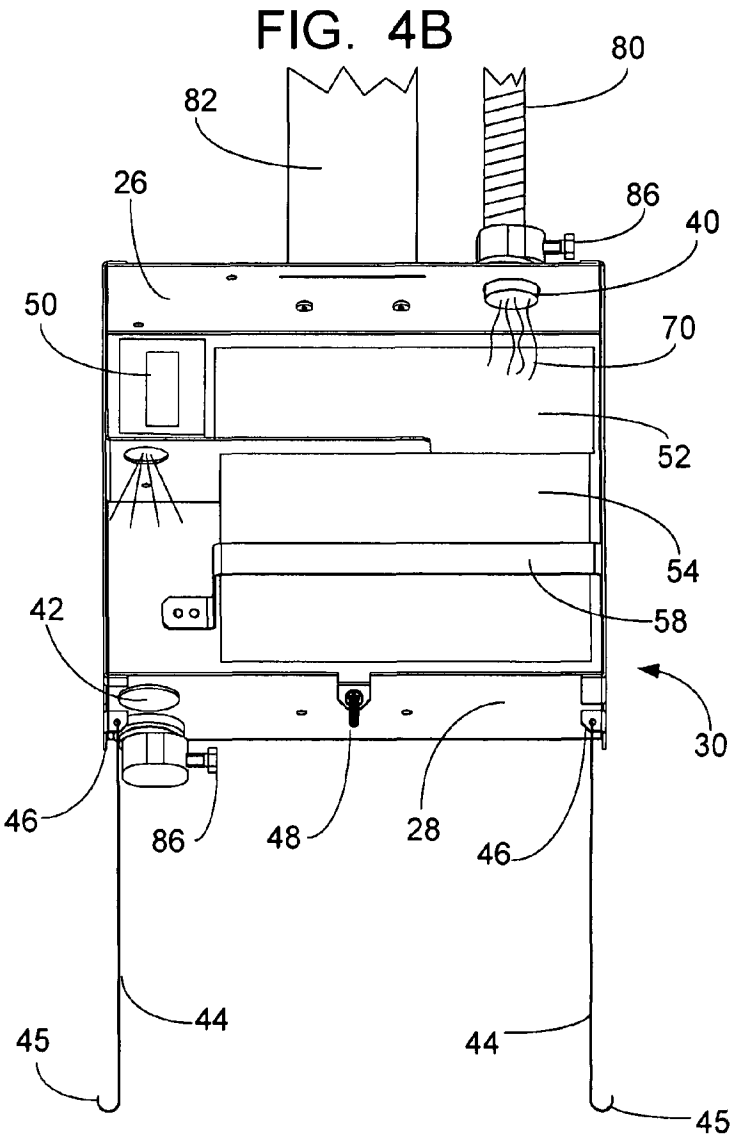
FIG. 4B is a front view of the power source box shown in FIG. 4A with two rotatable hangers extending from the bottom of the box.
Figure 4A:
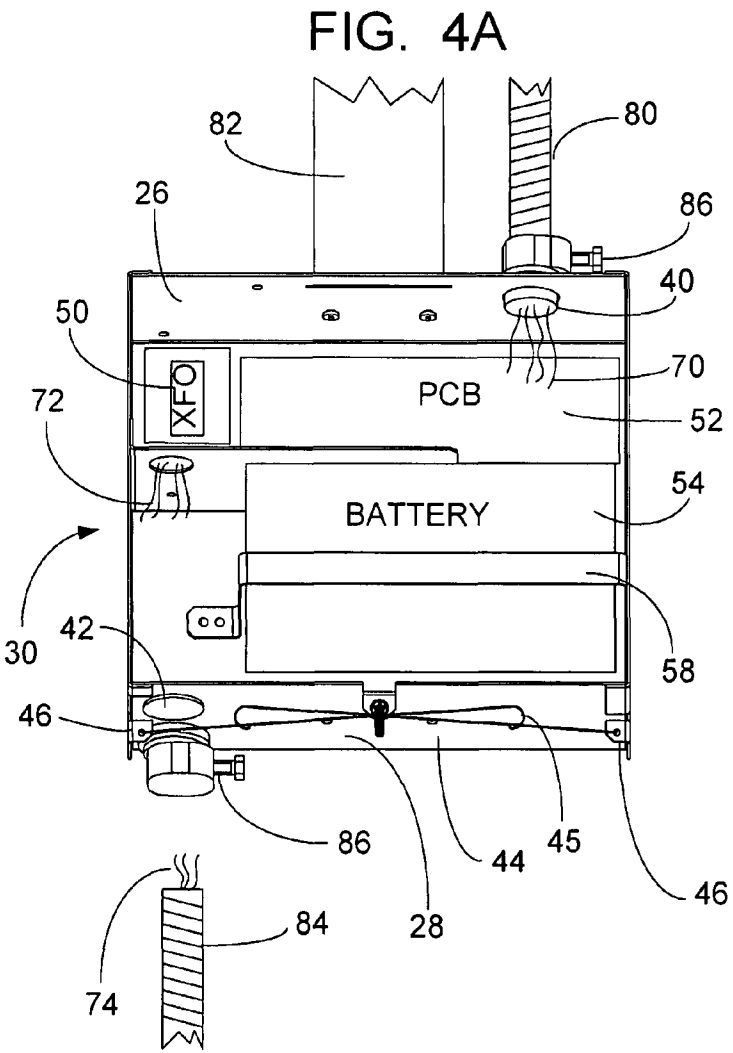
FIG. 4A is a front view of an embodiment of the power source box showing the components mounted inside the box.

FIG. 4A is a front view of the power source box 30 and shows the components (a transformer 50, printed circuit board 52 and battery 54) mounted inside. Wires 70 from the lamp assembly box 10 enter the power source box 30 through an opening 40 in the top end wall 26 and wires 74 from the power source cable 84 enter the box 30 through an opening 42 in the bottom end wall 28. The power source wires 74 are connected in the box 30 to the power source box termination wires 72. The power source box 30 contains a transformer 50, a printed circuit board ("PCB") 52 and a battery 54. After the power source cable 84 is secured to the power source box 30 by a coupling 86, the power source wires 74 are connected to the power source box termination wires 72. The battery 54 is secured in the box 30 by a bracket 58.

FIG. 4B shows the power source box 30 with the two rotatable hangers 44 extending from the bottom end wall 28 of the box 30. Each of the hangers 44 is attached to the bottom end wall 28 of the power source box 30 at one end by an eyelet 46. The other end of the hanger 44 has a hook 45. The hangers 44 are used to attach the power source box 30 to the U-shaped bracket 60 (FIG. 8) during installation so that the user can make the electrical connections between the power source cable 84 and the power source box termination wires 72.

FIG. 5A is a side view of the power source box 30 with the cover 32 removed. The top end 34 of the cover 32 is bent at about a 90 degree angle and a tab 36 extends downwardly from the top end 34. The bottom end 38 of the cover 32 is also bent at about a 90-degree angle and extends outwardly to form a lip 35 (FIG. 5B). A notch 37 in the middle of the lip 35 engages the screw 48 on the bottom end wall 28 of the box 30. The screw 48 is tightened to secure the cover 32 to the box 30 (FIG. 5C).

Figure 6:
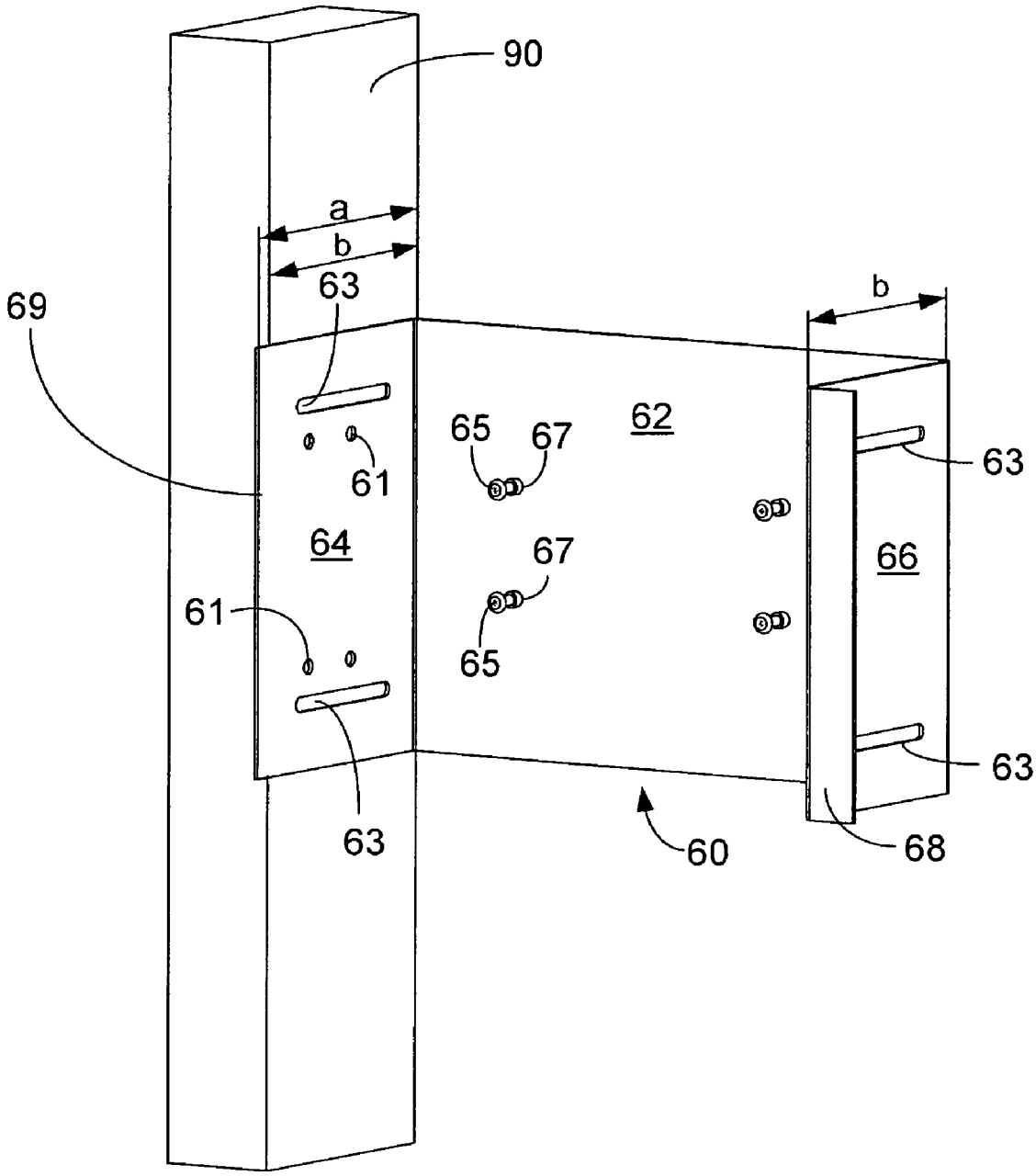
FIG. 6 is a perspective view of an embodiment of the mounting bracket for the lamp assembly box attached to a wall stud.

FIG. 6 shows a U-shaped mounting bracket 60 for the lamp assembly box 10 (FIG. 3) attached to a wall stud 90. The bracket 60 has a back wall 62, a first side wall 64 and a second side wall 66. A plurality of PEM® nuts 67 are installed in the back wall 62 with a plurality of screws 65 partially inserted in the PEM® nuts 67. The positions of the PEM® nuts 67/screws 65 correspond to the keyhole apertures 18 in the back wall 16 of the lamp assembly box 10 (FIG. 1B). When the lamp assembly box 10 is installed in the U-shaped bracket 60, the heads of the screws 65 pass through the larger portion of the keyhole apertures 18 and the box 10 is then moved downwardly so that the smaller portions of the keyhole apertures 18 engage the shafts of the screws 65. The screws 65 are tightened to secure the lamp assembly box 10 to the U-shaped bracket 60.

Figure 8:
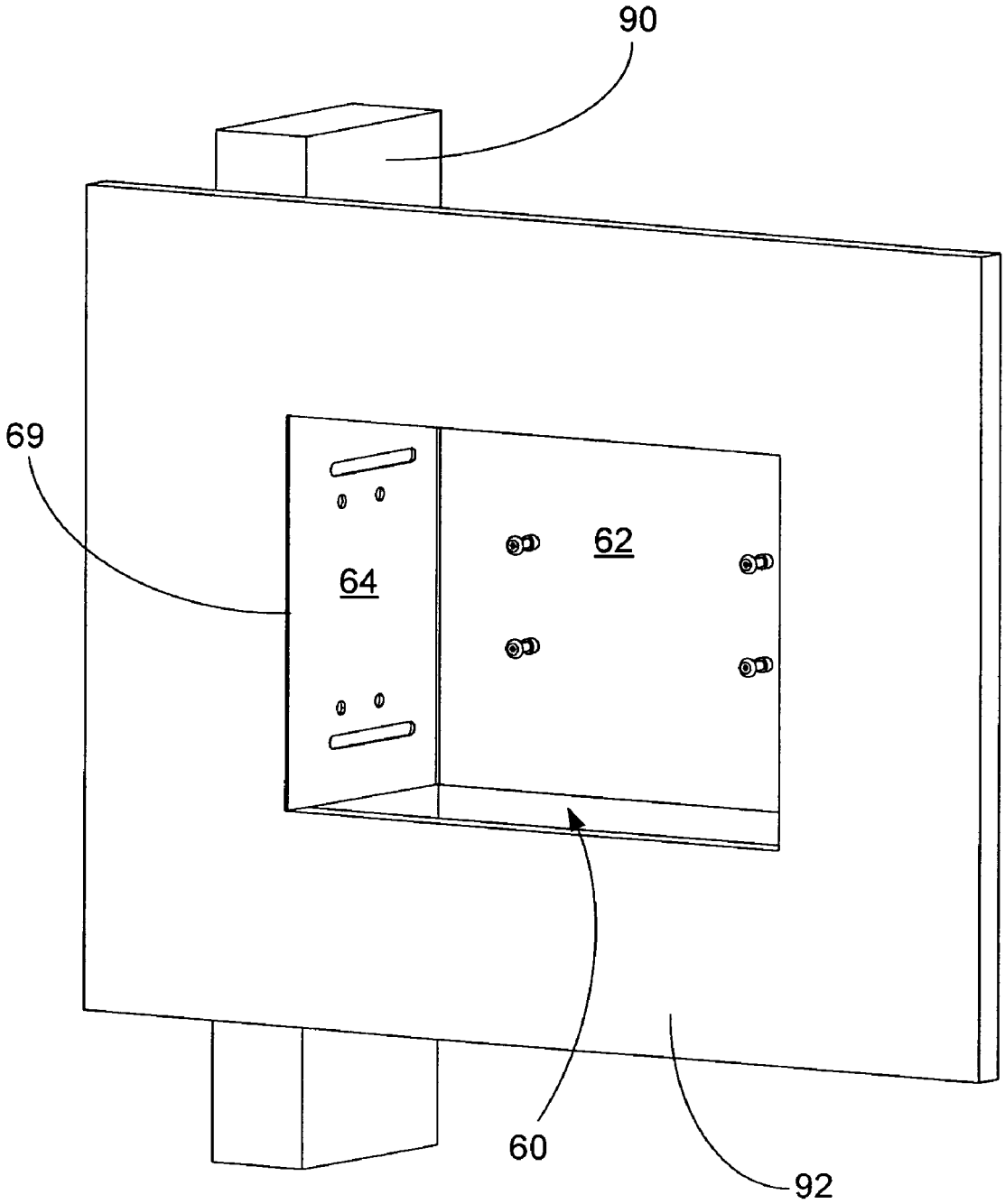
FIG. 8 is a perspective view of mounting bracket shown in FIG. 6 for the lamp assembly box attached to a wall stud through an opening in the wall.

FIG. 6 also shows mounting holes 61 in the fist side wall 64, which are used to attach the bracket to the stud 90. The second side wall 66 has a flanged end 68 which fits flush against the interior surface of the wall 92 (FIG. 3) when the bracket 60 is installed. Each of the side walls 64, 66 also has a pair of slots 63 which are used to receive the hooks 45 of the hangers 44 during installation. In this embodiment, dimension "a" in FIG. 6 is greater than the total width of the stud 90 and the wall 92. When the bracket 60 is attached to the stud 90, the front edge 69 of side wall 64 extends into the opening 98 in the wall 92 (FIG. 8). Dimension "b" is about equal to the width of the stud 90, which is typically the maximum depth of the wall cavity 96 (FIG. 3).

Figure 7:
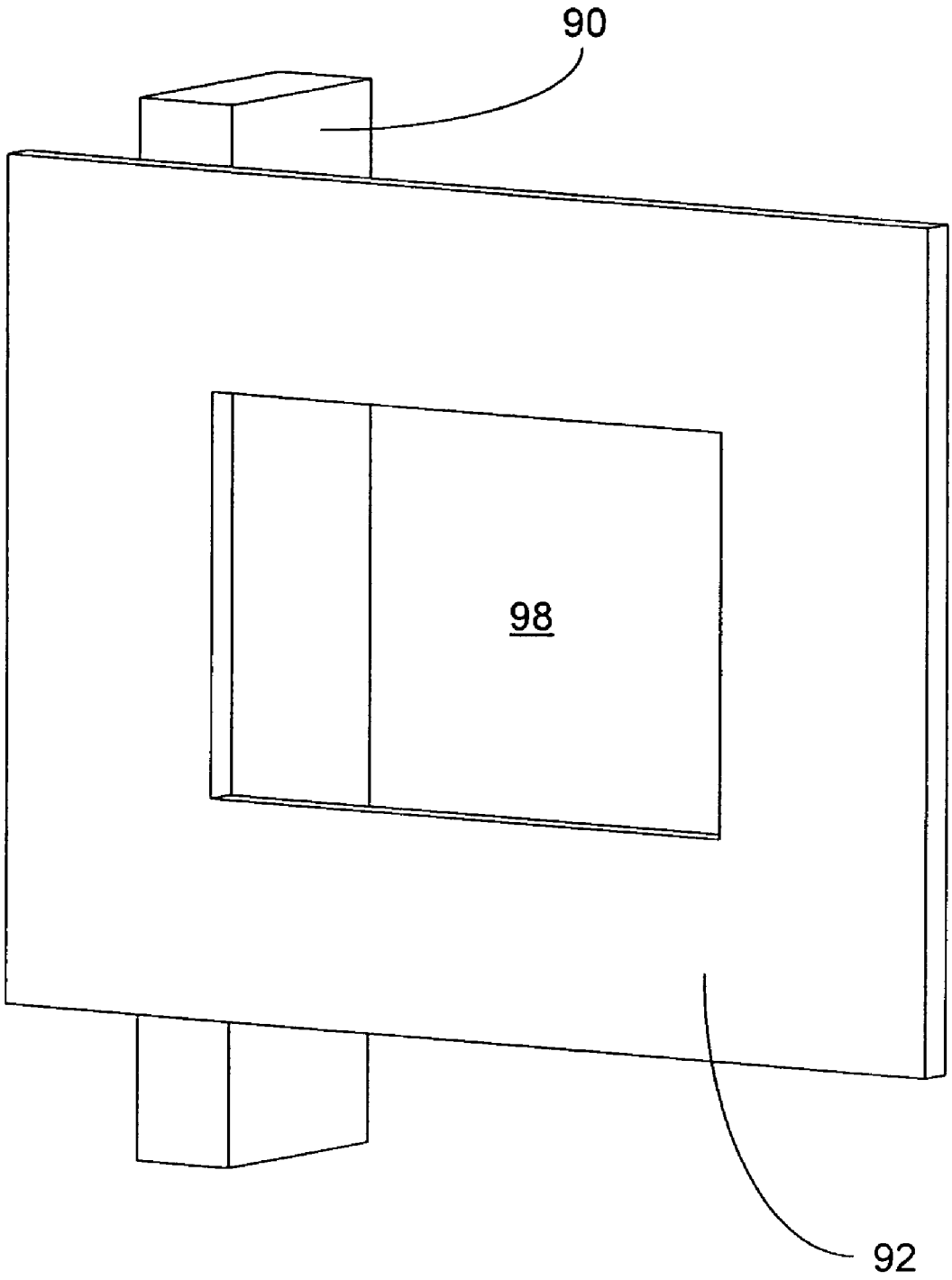
FIG. 7 is a perspective view of an opening cut in a wall for installing the emergency lighting assembly.

FIG. 7 shows an opening 98 formed in a wall 92 for installing the emergency lighting system 8 (not shown). One side of the opening is flush with the wall stud 90. FIG. 8 shows the opening 98 in the wall 92 after the U-shaped bracket 60 is installed.

Figure 9:
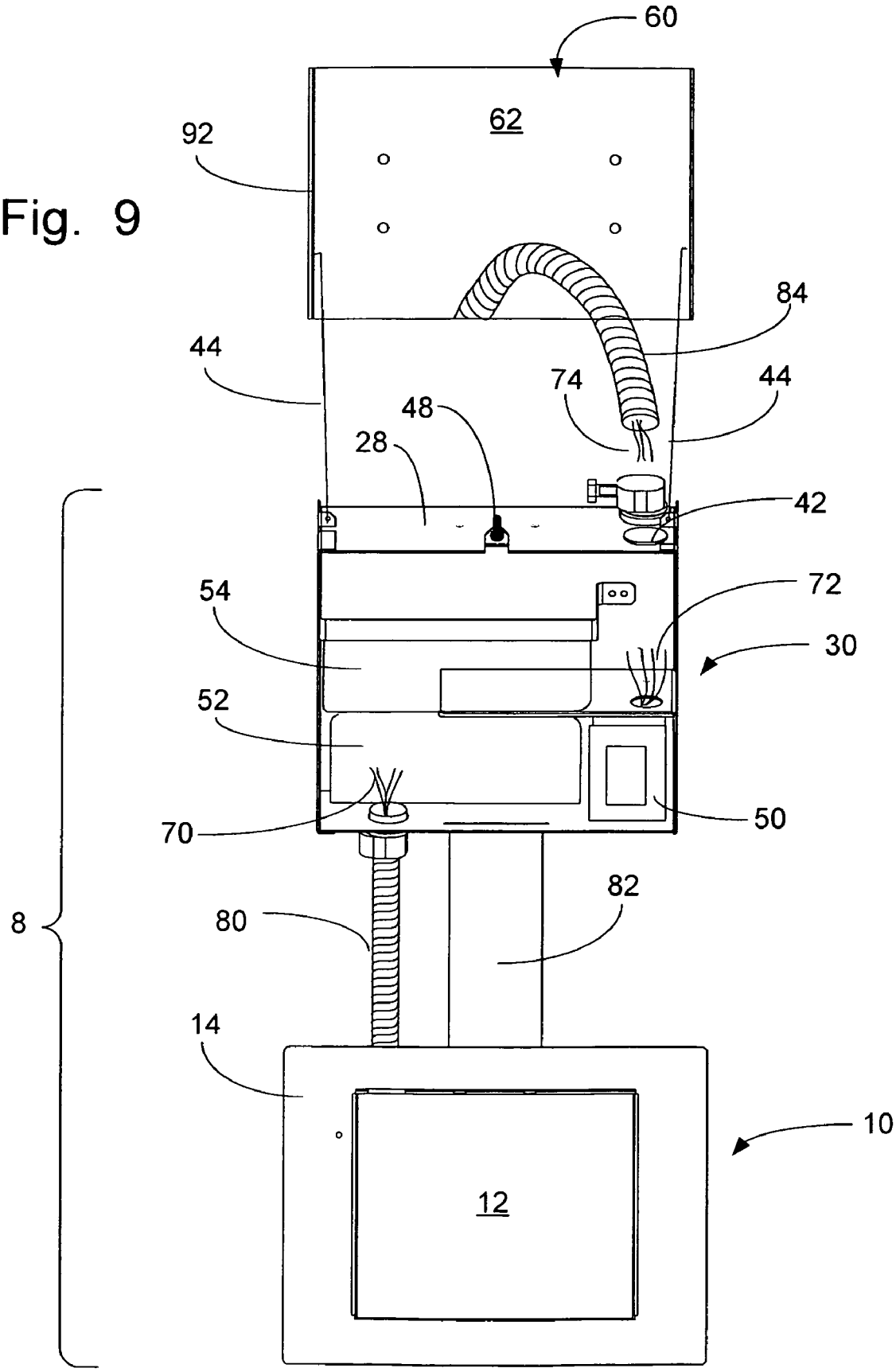
FIG. 9 is a front view of the emergency lighting system and shows the lamp assembly box connected to the power source box by an armored cable and flexible support and suspended from a wall opening by a pair of rotatable hangers.

FIG. 9 shows the emergency lighting system 8 suspended from the mounting bracket 60 by the pair of rotatable hangers 44 in an inverted position. In this configuration, the user can easily connect the wires 74 in the power source cable 84 to the power source termination wires 72. The front door 12 of the lamp assembly box 10 and the open side of the power source box 30 face away from the wall so that the interiors are accessible. Before the emergency lighting system 8 is installed in the wall, the lamp assembly box 10 and the power source box 30 are turned over so that the fronts face the wall.

Figure 10:
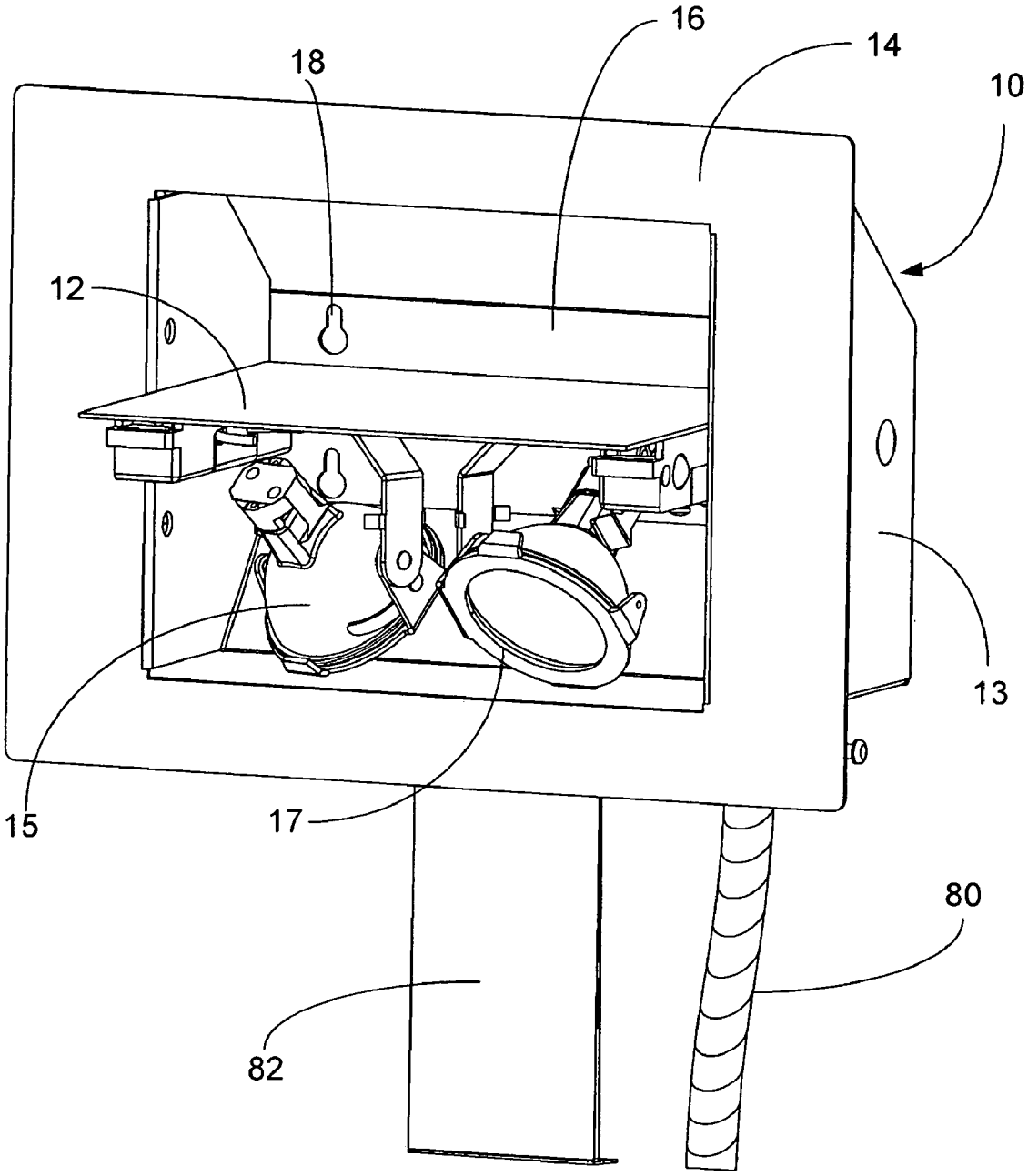
FIG. 10 shows a front peripheral view of an embodiment of the lamp assembly box with the front door partially open.

FIG. 10 shows the lamp assembly box 10 with the front door 12 partially open. The front door 12 is attached to the box 12 on either side so that it pivots about its horizontal axis. Two lamp assemblies 15,17 are mounted on the rear side of the front door 12 and, when the concealed emergency lighting system 8 is operating, the front door 12 pivots 180-degrees so that the lamp assemblies 15, 17 are on the outside of the box 10.

EXAMPLE

The concealed emergency lighting system described above can be installed in a wall by the following steps:

1. Form a rectangular opening in the drywall next to a stud (FIG. 7). The back wall of the U-shaped bracket can be used as a template to mark the lines on the wall.
2. Slide the U-shaped bracket (flanged side first) through the opening in the wall and attach it to the stud using one or more screws (FIG. 8).
3. Remove the cover of the power source box and disengage the two hangers (FIG. 4B) on the bottom of the box so that they extend freely.
4. Turn the emergency lighting system upside-down and attach the power source box to the U-shaped bracket using the hook ends of the hangers with the fronts of the two boxes facing away from the wall (FIG. 9).
5. Pass the AC (and optionally DC) cable through the opening in the power source box. Mechanically secure the cable to the power source box using a coupling and make the electrical connections for the AC (and/or DC) wires inside the power source box.
6. Install the cover on the power source box (FIG. 5) and secure it in place by tightening the screw.
7. Disengage the hangers from the U-shaped bracket and secure the two hook ends to the bottom of the power source box.
8. Turn the emergency lighting system so that the front door of the lamp assembly box and the front cover of the power source box face the wall. Insert the power source box through the opening in the wall and turn it so that it moves downwardly into the wall cavity. Rotate the front door of the lamp assembly box to a half-open position and hold the lamp assembly box as the power source box slides into the wall cavity.
9. Rotate the lamp assembly box as it passes through the opening in the wall and then insert the screws in the back wall of the U-shaped bracket through the keyhole apertures in the back wall of the box.
10. Tighten the screws in the keyhole apertures through the opening in the front of the lamp assembly box until the face plate of the lamp assembly box is flush to the wall surface.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

We claim:

1. A concealed emergency lighting system comprising:

a lamp assembly box comprising:

a back wall;

four contiguous side walls extending from the back wall to form a front opening defined by a perimeter;

a face plate substantially parallel to the back wall extending outwardly from the perimeter;

a front door pivotably moveable between an open position and a closed position; and a lamp assembly;

a power source box comprising:

a back wall;

four contiguous side walls extending from the back wall to form a front opening;

a front cover; and a battery; and a flexible armored cable for housing one or more wires or cables connecting the lamp assembly box and the power source box.

2. The concealed emergency lighting system according to claim 1, wherein the front cover is detachable.

3. The concealed emergency lighting system according to claim 1, wherein the system further comprises a mounting bracket.

4. The concealed emergency lighting system according to claim 1, wherein the system further comprises a flexible support connecting the lamp assembly box and the power source box.

5. The concealed emergency lighting system according to claim 1, wherein the power source box further comprises:

a battery charger;

one or more printed circuit boards; and a transformer.

6. The concealed emergency lighting system according to claim 1, wherein the power source box further comprises a pair of rotatable hangers that are adapted to support the emergency lighting system.

7. A concealed emergency lighting system comprising:

a mounting bracket;

a lamp assembly box comprising:

a back wall;

four contiguous side walls extending from the back wall to form a front opening defined by a perimeter;

a face plate substantially parallel to the back wall extending outwardly from the perimeter;

a front door pivotably moveable between an open position and a closed position; and a lamp assembly;

a power source box comprising:

a back wall;

four contiguous side walls extending from the back wall to form a front opening;

a front cover;

a battery;

a battery charger;

one or more printed circuit boards; and a transformer; and a flexible armored cable for housing the electrical wire connecting the lamp assembly box and the power source box;

wherein the lamp assembly is connected to the battery by one or more wires or cables.

8. The concealed emergency lighting system according to claim 7, wherein the front cover is detachable.

9. The concealed emergency lighting system according to claim 7, wherein the system further comprises a flexible armored cable for housing the electrical wire connecting the lamp assembly box and the power source box.

10. The concealed emergency lighting system according to claim 7, wherein the power source box further comprises a pair of rotatable hangers that are adapted to support the emergency lighting system.

11. A method of installing a concealed emergency lighting system in a wall with a wall cavity, wherein the emergency lighting system comprises a lamp assembly box having a front door and a back wall with one or more mounting apertures and containing a lamp assembly, a power source box having a cover, four side walls and two hangers attached to one of the side walls and containing one or more power source devices, a mounting bracket with mounting screws and a flexible armored cable and a flexible support connecting the lamp assembly box and the power source box, the method of installing the concealed emergency lighting system comprising:

forming an opening in a wall next to a stud;

inserting the mounting bracket through the opening and attaching the mounting bracket to the stud;

attaching the power source box to the mounting bracket using the hangers;

connecting a power source to the one or more power source devices in the power source box;

disengaging the hangers from the mounting bracket;

inserting the power source box through the opening in the wall and into the wall cavity;

inserting the lamp assembly box through the opening in the wall;

passing the screws in the mounting bracket through the mounting apertures in the back wall of the lamp assembly box; and tightening the screws to secure the lamp assembly box to the mounting bracket.

12. The method of installing a concealed emergency lighting system in a wall according to claim 11 further comprising positioning the emergency lighting system so that the front door of the lamp assembly box and the cover of the power source box face away from the wall prior to connecting a power source to the one or more power source devices.

13. The method of installing a concealed emergency lighting system in a wall according to claim 11 further comprising installing the cover on the power source box prior to disengaging the hangers from the mounting bracket.

* * * * *